US010451274B2

(12) United States Patent
Ulyanov et al.

(10) Patent No.: US 10,451,274 B2
(45) Date of Patent: Oct. 22, 2019

(54) METHOD AND SYSTEM FOR EFFLUENT COMBUSTION

(71) Applicant: Schlumberger Technology Corporation, Sugar land, TX (US)

(72) Inventors: Vladimir Nikolaevich Ulyanov, Novosibirsk (RU); Roman Vladimirovich Korkin, Berdsk (RU); Alexander Nikolaevich Cheremisin, Tyumen (RU); Vladimir Konstantinovich Khan, Novosibirsk (RU)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 524 days.

(21) Appl. No.: 15/021,570

(22) PCT Filed: Sep. 13, 2013

(86) PCT No.: PCT/RU2013/000797
§ 371 (c)(1),
(2) Date: Mar. 11, 2016

(87) PCT Pub. No.: WO2015/038024
PCT Pub. Date: Mar. 19, 2015

(65) Prior Publication Data
US 2016/0230988 A1 Aug. 11, 2016

(51) Int. Cl.
*F23C 1/08* (2006.01)
*F23G 7/05* (2006.01)
(Continued)

(52) U.S. Cl.
CPC ..... *F23G 7/05* (2013.01); *E21B 41/0071* (2013.01); *F23C 1/08* (2013.01); *F23D 11/16* (2013.01);
(Continued)

(58) Field of Classification Search
CPC ..... F23G 7/05
(Continued)

(56) References Cited

U.S. PATENT DOCUMENTS 3,565,562 A 2/1971 Drivet
3,894,831 A 7/1975 Glotin et al.
(Continued)

FOREIGN PATENT DOCUMENTS

EP 1790907 A1 5/2007
EP 2587151 A2 5/2013
(Continued)

OTHER PUBLICATIONS

U.K. Doring, P.Le Foll, Well-testing fluid disposal in an environmentally sensitive offshore area, SPE 61130, presented in Stavanger, Norway, Jun. 26-28, 2000 (10 pages).
(Continued)

*Primary Examiner* — Avinash A Savani
(74) *Attorney, Agent, or Firm* — Cameron R. Sneddon

(57) ABSTRACT

Methods and systems of burning a multi-phase hydrocarbon fluid include determining a water content of the multi-phase hydrocarbon fluid, communicating the multiphase hydrocarbon fluid to a fuel port of a burner in a primary fuel flow, initiating a flame at the burner to combust the multi-phase hydrocarbon fluid, communicating an auxiliary fuel source to the burner fuel port in an auxiliary fuel flow, and controlling the primary and auxiliary fuel flows based on the water content of the multi-phase hydrocarbon fluid.

24 Claims, 3 Drawing Sheets

(51) Int. Cl.

| | |
|---|---|
| ***F23K 5/10*** | (2006.01) |
| ***F23K 5/12*** | (2006.01) |
| ***F23N 1/00*** | (2006.01) |
| ***F23N 5/00*** | (2006.01) |
| ***F23G 5/50*** | (2006.01) |
| ***F23G 7/00*** | (2006.01) |
| ***F23D 11/16*** | (2006.01) |
| ***E21B 41/00*** | (2006.01) |

(52) U.S. Cl.

CPC ..... *F23G 5/50* (2013.01); *F23G 7/001* (2013.01); *F23K 5/10* (2013.01); *F23K 5/12* (2013.01); *F23N 1/002* (2013.01); *F23N 5/003* (2013.01); *F23G 2204/103* (2013.01); *F23G 2207/103* (2013.01); *F23G 2207/104* (2013.01); *F23G 2207/106* (2013.01); *F23G 2207/20* (2013.01); *F23G 2900/55011* (2013.01); *F23G 2900/7013* (2013.01); *F23K 2301/103* (2013.01); *F23K 2301/206* (2013.01); *F23K 2900/05001* (2013.01); *F23K 2900/05141* (2013.01)

(58) Field of Classification Search

USPC ..... 431/12

See application file for complete search history.

(56) References Cited

U.S. PATENT DOCUMENTS

| | | | | |
|---|---|---|---|---|
| 4,250,553 | A | 2/1981 | Sebens et al. | |
| 4,419,071 | A | 12/1983 | Schwartz | |
| 4,655,706 | A | 4/1987 | Bayh, III | |
| 4,761,948 | A | 8/1988 | Sood et al. | |
| 5,096,124 | A | 3/1992 | Young | |
| 5,219,456 | A | 6/1993 | Theriot | |
| 5,636,980 | A | 6/1997 | Young et al. | |
| 6,378,511 | B1 * | 4/2002 | Wolters ..... | F02D 19/081 123/525 |
| 6,872,071 | B1 | 3/2005 | Durst | |
| 2002/0194902 | A1 | 12/2002 | Gehner et al. | |
| 2005/0165535 | A1 | 7/2005 | Miller | |
| 2009/0072041 | A1 | 3/2009 | Hashiba | |
| 2012/0141899 | A1 * | 6/2012 | Yamanaka ..... | H01M 8/04291 429/444 |
| 2015/0045971 | A1 | 2/2015 | Endel et al. | |
| 2018/0216819 | A1 | 8/2018 | Carelli et al. | |

FOREIGN PATENT DOCUMENTS

| | | | |
|---|---|---|---|
| GB | 2307294 | A | 5/1997 |
| JP | 2001173930 | A | 6/2001 |
| JP | 2001324120 | A | 11/2001 |
| RU | 2115176 | C1 | 7/1998 |
| RU | 2131094 | C1 | 5/1999 |
| RU | 2144627 | C1 | 1/2000 |
| RU | 2207449 | C1 | 6/2000 |
| RU | 36135 | U1 | 2/2004 |
| RU | 2228217 | C1 | 5/2004 |
| RU | 2244174 | C1 | 1/2005 |
| RU | 2310132 | C1 | 11/2007 |
| SU | 1333968 | A1 | 8/1987 |
| SU | 1393997 | A1 | 5/1988 |
| WO | WO03008347 | A1 | 1/2003 |
| WO | 2010147496 | A1 | 12/2010 |
| WO | 2014120235 | A1 | 8/2014 |

OTHER PUBLICATIONS

Y. El-Khazindar, M. Ramzi Darwish, A. Tengirsek, Environmetally Friendly Well Testing, SPE 74106, presented in Kuala Lumpur, Malaysia, Mar. 20-22, 2002 (6 pages).

Lin, C.-Y., Lin, S.-A. Effects of emulsification variables on fuel properties of two- and three-phase biodiesel emulsion. (2007) Fuel, 86 (1-2), pp. 210-217.

Adiga, K.S., Vaporization and combustion behavior of water-in-oil microemulsion of petroleum distillates, American Society of Mechanical Engineers, Petroleum Division PD, 41, pp. 9-14.

S.R. Gollahalli et al., Combustion of drops and sprays of No. 2 diesel oil and its emulsions with water, Eighteenth Symposium (international) on Combustion, vol. 18, Issue 1, 1981, pp. 349-360.

Y. Mizutani, A. Taki, Mechanisms and Characteristics of Combustion of water-in oil emulsion spray, ASME Publication, 80-WA/HT-36.

P.H. Janssen, Emulsion formation in a model choke-valve, SPE Annual technical Conference and Exhibition, Sep. 30-Oct. 3, 2001, New Orleans, USA, SPE 71473-MS.

M.A. Baloch, G.Hameed, Emulsification of oil in water as affected by different parameters, J. of Colloidal and Interface Science, vol. 285 (2005), pp. 804-813.

O.Behrend, H.Schubert, Influence of hydrostatic pressure and gas content on continuous ultrasound emulsification, Ultrasonic Sonochemistry, vol. 8 (2001), pp. 271-276.

J.Gingras, et al., Inline bitumen emulsification using static mixers, Ind. Eng. Chem. Res., 2007, vol. 46, pp. 2618-2627.

T. Lemenand et al., Droplets formation in turbulent mixing of two immiscible fluids in a new type of a static mixer, Int.J. of Multiphase Flow, vol. 29, 2003, pp. 813-840.

B.J. and C.E. Baukal, Spectral Radiation properties of Oxygen-Enhanced/Natual Gas Flames, Proc. Int. Gas. Research Conf., Nov 8-11, 1998, San Diego, CA, D.Dolenc, Ed., 5, 422-433, 1998.

Phasing Out Separation, in Middle East Reservoir Review, 2003, No. 3, p. 24-31.

International Preliminary Report on patentability issued in the related PCT application PCT/RU2013/000797, dated Mar. 24, 2016 (6 pages).

European Search Report issued in the related EP Application 13893581.2, dated Apr. 3, 2017 (3 pages).

EP Communication Article 94-3 issued in the related EP Application 13893581.2, dated Apr. 24, 2017 (6 pages).

Decision of Grant issued in the related RU application 2016113689, dated Jun. 8, 2017 (26 pages).

International Search Report and Written Opinion issued in PCT/RU2013/000797 dated Jun. 19, 2014; 7 pages.

International Search Report and Written opinion issued in the related PCT application PCT/US2016/0044599, dated Oct. 28, 2016 (14 pages).

International Preliminary report on patentability issued in the related PCT application PCT/US2016/0044599, dated Jan. 30, 2018 (10 pages).

Extended Search Report issued in the related EP Application 16831387.2, dated Mar. 4, 2019 (6 pages).

* cited by examiner

METHOD AND SYSTEM FOR EFFLUENT COMBUSTION

FIELD OF THE DISCLOSURE

This disclosure generally relates to hydrocarbon disposal, and more particularly to apparatus and methods for combusting multi-phase fluids containing hydrocarbons.

BACKGROUND OF THE DISCLOSURE

Hydrocarbons are widely used as a primary source of energy, and have a significant impact on the world economy. Consequently, the discovery and efficient production of hydrocarbon resources is increasingly important. As relatively accessible hydrocarbon deposits are depleted, hydrocarbon prospecting and production has expanded to new regions that may be more difficult to reach and/or may pose new technological challenges. During typical operations, a borehole is drilled into the earth, whether on land or below the sea, to reach a reservoir containing hydrocarbons. Such hydrocarbons are typically in the form of oil, gas, or mixtures thereof which may then be brought to the surface through the borehole.

Well testing is often performed to help evaluate the possible production value of a reservoir. During well testing, a test well is drilled to produce a test flow of fluid from the reservoir. During the test flow, key parameters such as fluid pressure and fluid flow rate are monitored over a time period. The response of those parameters may be determined during various types of well tests, such as pressure drawdown, interference, reservoir limit tests, and other tests generally known by those skilled in the art. The data collected during well testing may be used to assess the economic viability of the reservoir. The costs associated with performing the testing operations may be significant, however, and therefore testing operations should be performed as efficiently and economically as possible.

Fluids produced from the test well are typically disposed of by burning, which raises environmental and safety concerns. For example, conventional burners may not completely combust the well fluids, thereby releasing black smoke and other pollutants into the surrounding environment. To reduce the amount of smoke produced during well test burning, many have proposed (such as at U.S. Pat. Nos. 3,565,562; 3,894,831; 4,419,071; and 5,096,124) to inject water into the flame, thereby to decrease the combustion temperature. Another approach, disclosed in British Patent No. GB 2,307,294, provides a burner that injects an air/water mixture into a combustion zone to reduce black smoke and other pollutants. These approaches require significant amounts of water, often in volumes greater than the amount of fluid produced during well testing. If sea water is used, as is typical for offshore well sites, chlorine and other deleterious compounds may be released into the environment. Additionally, because the hydrocarbon content of the well effluent may vary, these previous devices may cause incomplete combustion of the effluent, thereby releasing pollutants as well as unburned hydrocarbon effluent into the surrounding area.

SUMMARY OF THE DESCRIPTION

Apparatus and methods are disclosed herein for combusting fluids having a hydrocarbon content. The fluids may be generated during well testing, oil spill cleanup, or other operations. According to the apparatus and methods disclosed herein, multi-phase hydrocarbon fluid is burned in an automated and environmentally-friendly manner without requiring separation of the water content from the hydrocarbon fluid. A feedback control loop is used that determines the water content of the incoming fluid and/or the quality of combustion produced by a burner and selectively adds an auxiliary fuel as needed. Emission gases may also be monitored to determine whether air supply to the burner should be increased or decreased.

In accordance with certain aspects of the disclosure, a method of burning a multi-phase hydrocarbon fluid includes determining a water content of the multi-phase hydrocarbon fluid, communicating the multi-phase hydrocarbon fluid to a fuel port of a burner in a primary fuel flow, initiating a flame at the burner to combust the multi-phase hydrocarbon fluid, communicating an auxiliary fuel source to the burner fuel port in an auxiliary fuel flow, and controlling the primary and auxiliary fuel flows based on the water content of the multi-phase hydrocarbon fluid.

In accordance with additional aspects of the disclosure, an apparatus for combusting a multi-phase hydrocarbon fluid may include a multi-phase flowmeter having a multi-phase flowmeter inlet fluidly communicating with a source of the multi-phase hydrocarbon fluid and a multi-phase flowmeter outlet, the multi-phase flowmeter being configured to determine a water content of the multi-phase hydrocarbon fluid. A burner may have a fuel port fluidly communicating with the multi-phase flowmeter outlet to receive a primary fuel flow of multi-phase hydrocarbon fluid, and an igniter configured to initiate a flame at the burner to combust the multi-phase hydrocarbon fluid. An auxiliary fuel source fluidly communicates with the burner fuel port, and an auxiliary fuel valve is disposed between the auxiliary fuel source and the burner fuel port, the auxiliary fuel valve having a first position configured to block an auxiliary fuel flow to the burner fuel port and a second position configured to permit the auxiliary fuel flow to the burner fuel port. A controller is operatively coupled to the multi-phase flowmeter and the auxiliary fuel valve, the controller being programmed to control the primary and auxiliary fuel flows based on the water content of the multi-phase hydrocarbon fluid.

The summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Embodiments of methods and apparatus for combusting a multi-phase hydrocarbon fluid are described with reference to the following figures. The same numbers are used throughout the figures to reference like features and components.

It should be understood that the drawings are not necessarily to scale and that the disclosed embodiments are sometimes illustrated diagrammatically and in partial views.

In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION

So that the above features and advantages of the present disclosure can be understood in detail, a more particular description of the disclosure, briefly summarized above, may be had by reference to the embodiments thereof that are illustrated in the accompanying drawings. It is to be noted, however, that the drawings illustrate only typical embodiments of this disclosure and therefore are not to be considered limiting of its scope, for the disclosure may admit to other equally effective embodiments.

Methods and apparatus are disclosed herein for use with a multi-phase hydrocarbon fluid. The term "multi-phase hydrocarbon fluid" is intended to encompass any fluid having a water content and a hydrocarbon content (such as oil). Additionally, the multi-phase hydrocarbon fluid may have a gas content (such as methane). The multi-phase hydrocarbon fluid may be obtained from effluent from a supply line formed during well testing operations, oil-water mixtures created during an oil spill cleanup, or other sources.

Figure 1:
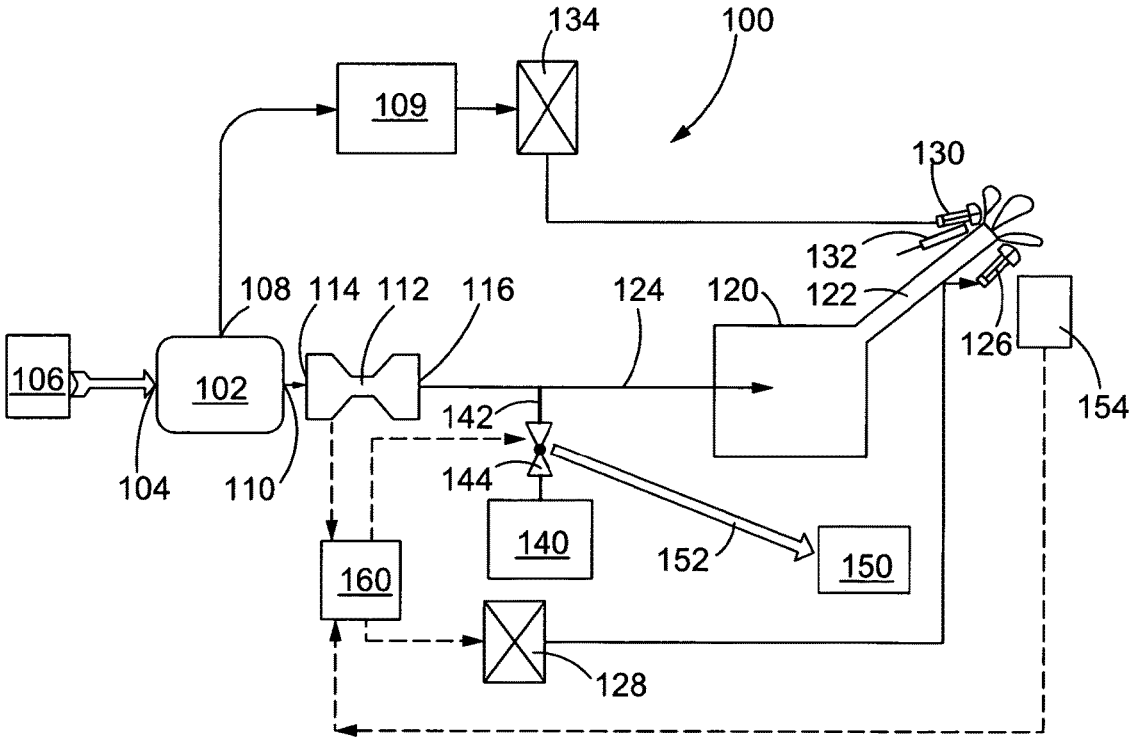
FIG. 1 is a diagrammatic view of a multi-phase hydrocarbon fluid burning apparatus constructed according to the present disclosure.

FIG. 1 illustrates a first embodiment of a multi-phase hydrocarbon fluid combustion system 100. The system 100 includes a separator 102 having a separator inlet 104 fluidly communicating with a source of the hydrocarbon fluid 106. The hydrocarbon fluid source 106 may be a well, oil spill, or other source of multi-phase hydrocarbon fluid. The separator 102 is configured to separate at least a portion of a gas content of the multi-phase hydrocarbon fluid. For example, the separator 102 may be a two-phase separator configured to separate gas from liquid, such as a gravity drained separator. In some embodiments, a cyclone separator may be advantageously used. Separated gas may exit the separator 102 from a separator gas outlet 108 to be collected in a gas reservoir 109, while the remaining fluid exits a separator liquid outlet 110.

The remaining fluid exiting the separator liquid outlet 110, which is the multi-phase hydrocarbon fluid with at least a portion of its gas content removed, is referred to herein as a "multi-phase hydrocarbon liquid" to distinguish it from the unprocessed, multi-phase hydrocarbon fluid entering the system 100. The multi-phase hydrocarbon liquid may be primarily an oil/water mixture, where the oil may be any flammable substance such as crude oil, oil-based mud, and the like while the water may be any inflammable substance such as sea water, water-based mud, and the like. Regardless of the specific components of the multi-phase hydrocarbon liquid, it will have a measurable production rate of hydrocarbon content (i.e., flammable content) and water content (i.e., inflammable content). Additionally, the multi-phase hydrocarbon liquid may also still include some residual gas content.

The multi-phase hydrocarbon fluid combustion system 100 may also include a multi-phase flowmeter 112 for analyzing the multi-phase hydrocarbon liquid exiting the separator liquid outlet 110. Accordingly, the flowmeter 112 includes a flowmeter inlet 114 in fluid communication with the separator liquid outlet 110 and a flowmeter outlet 116. In the exemplary embodiments, the multi-phase flowmeter 112 is configured to determine a water content and a hydrocarbon content of the multi-phase hydrocarbon liquid. Accordingly, the flowmeter 112 may be any device capable of determining water and/or hydrocarbon content of a liquid, such as devices that measure water/oil conductivity, capacity, or attenuation of gamma-rays passing through the liquid flow.

In some embodiments, the flowmeter 112 may be a "Vx-type" flowmeter as marketed by Schlumberger, Inc. The Vx-type flowmeter measures a differential pressure and gamma ray attenuation (at two or more energy levels) in a Venturi throat portion of the flowmeter. The pressure and attenuation information is then used to determine total mass flow rate, water content, and gas content of the multi-phase hydrocarbon liquid.

The exemplary system 100 also includes a burner 120 for combusting the multi-phase hydrocarbon liquid. The burner 120 includes a fuel port 122 fluidly communicating with the flowmeter outlet 116, such as through burner pipe 124, to receive a primary fuel flow of multi-phase hydrocarbon liquid. The burner 120 may also include an air port 126 fluidly communicating with an air source 128 (such as an air compressor) to provide an air flow for combusting the liquid.

A pilot port 130 and igniter 132 are provided to initiate a flame at the burner 120. The pilot port 130 fluidly communicates with a source of flammable gas. In some embodiments, the flammable gas source may be the gas reservoir 109, in which case a gas compressor 134 may be provided to deliver gas from the gas reservoir 109 to the pilot port 130.

The multi-phase hydrocarbon fluid combustion system 100 may further include an auxiliary fuel assembly for selectively delivering auxiliary fuel to the burner 120. The auxiliary fuel assembly may include an auxiliary fuel source, such as an auxiliary fuel tank 140, fluidly communicating with the burner fuel port 122. In the exemplary embodiment, an auxiliary fuel pipe 142 fluidly communicates between the auxiliary fuel tank 140 and the burner pipe 124, thereby placing the auxiliary fuel tank 140 and the burner fuel port 122 in fluid communication. An auxiliary fuel valve 144 is disposed in the auxiliary fuel pipe 142 between the auxiliary fuel source and the burner fuel port 122 to selectively control an auxiliary fuel flow to the burner 120. More specifically, the auxiliary fuel valve 144 may have an open position to permit the auxiliary fuel flow and a closed position to block the auxiliary fuel flow. Additionally or alternatively, the auxiliary fuel valve 144 may be controlled to be partially open in a "throttle position" that is between the fully open and fully closed positions. As such, the fuel valve 144 may be opened as needed to provide only the minimal or optimal amount of fuel in order to provide the proper mixture or amount or fuel to produce the needed combustion. In exemplary embodiments, the auxiliary fuel valve 144 may be a high speed, automatic, multi-switch valve.

The system 100 may also include a diverter tank 150 for receiving multi-phase liquid when combusting the liquid is not possible or desired. A diverter pipe 152 may fluidly communicate between the diverter tank 150 and the burner pipe 124. In the illustrated embodiment, the diverter pipe 152 is coupled to the auxiliary fuel valve 144, which may have a third position that permits fluid flow from the auxiliary fuel pipe 142 to the diverter tank 150.

An emission monitor 154 may be provided for determining a combustion quality of emission gases produced by the flame at the burner 120. In exemplary embodiments, the emission monitor 154 may be configured to determine one or more components of the emission gases, such as a NOx content, an O2 content, a CO content, a SO2 content, a benzpyrene content, a soot content, or other emission component indicative of combustion quality. For example, the emission monitor 154 may be a gas emission analyzer that uses a spectral radiometer for monitoring the fume emission spectrum.

A controller 160 is provided for controlling operation of various components of the multi-phase hydrocarbon fluid combustion system 100. The controller 160, which may include a processor, microprocessor, microcontroller, or other logic executing device, as well as memory, may be operatively coupled to the multi-phase flowmeter 112, the air source 128, the gas compressor 134, the auxiliary fuel valve 144, the igniter 132, and the emission monitor 154. The controller 160 may receive and interpret signals from these devices indicative of various measured parameters, and may send control signals for operating the devices, as discussed in greater detail below.

More specifically, the controller 160 may be operatively coupled to the multi-phase flowmeter and the auxiliary fuel valve 144 and programmed to control the primary and auxiliary fuel flows based on the water content of the multi-phase hydrocarbon liquid. In an exemplary embodiment, the controller 160 may be programmed to permit primary fuel flow to the burner 120 and block auxiliary fuel flow to the burner 120 (such as by placing the auxiliary fuel valve 144 in a first position) when the water content of the multi-phase hydrocarbon liquid is below a water content lower threshold. The water content lower threshold may be set at a water content value that indicates that the multi-phase hydrocarbon liquid may be efficiently combusted without addition of auxiliary fuel. In an exemplary embodiment, the water content lower threshold is approximately 20%.

Additionally, the controller 160 may be programmed to permit both primary and auxiliary fuel flows to the burner (such as by placing the auxiliary fuel valve 144 in a second position) when the water content is between the water content lower threshold and a water content upper threshold. The second position of the auxiliary fuel valve 144 may be the fully open position or a throttle position (i.e., partially open). When in a throttle position, the second position of the auxiliary fuel valve 144 may be modulated according to the water content of the effluent to optimize combustion. When the water content is within this range, the multi-phase hydrocarbon liquid is still capable being efficiently combusted, but it will require auxiliary fuel to do so. In an exemplary embodiment, the water content lower threshold may be approximately 25% and the water content upper threshold may be approximately 40%.

Still further, the controller 160 may be programmed to block both the primary and auxiliary fuel flows (such as by placing the auxiliary fuel valve 144 in a third position, where the multi-phase hydrocarbon liquid is communicated to the diverter tank 150) when the water content is above the water content upper threshold. When the water content is above the upper threshold, the multi-phase hydrocarbon liquid is incapable of efficient combustion, even with the addition of auxiliary fuel. Under these circumstances, the multi-phase hydrocarbon liquid may be directed to the diverter tank 150 for storage and/or reprocessing.

Additionally, the controller 160 may be programmed to control air flow to the burner based on the combustion quality of the emission gases. In some applications, the emission monitor 154 may be configured to determine the combustion quality of the emission gases by determining a NOx content, and the controller may be configured to increase the air flow when the NOx content is above an NOx threshold. Additionally or alternatively, the emission monitor 154 may be configured to determine the combustion quality of the emission gases by determining an O2 content, and the controller 160 may be programmed to increase the air flow rate when the O2 content is below an O2 lower threshold and decrease the air flow rate when the O2 content is above an O2 upper threshold.

In some embodiments, the controller 160 may be programmed to direct the multi-phase hydrocarbon fluid to the auxiliary fuel tank 140. When the multi-phase flowmeter 112 indicates that the multi-phase hydrocarbon fluid has a high hydrocarbon content, such as a hydrocarbon content greater than approximately 10%, the high-calorie hydrocarbon fluid may be stored in the auxiliary fuel tank 140 as a reserve.

Figure 2:
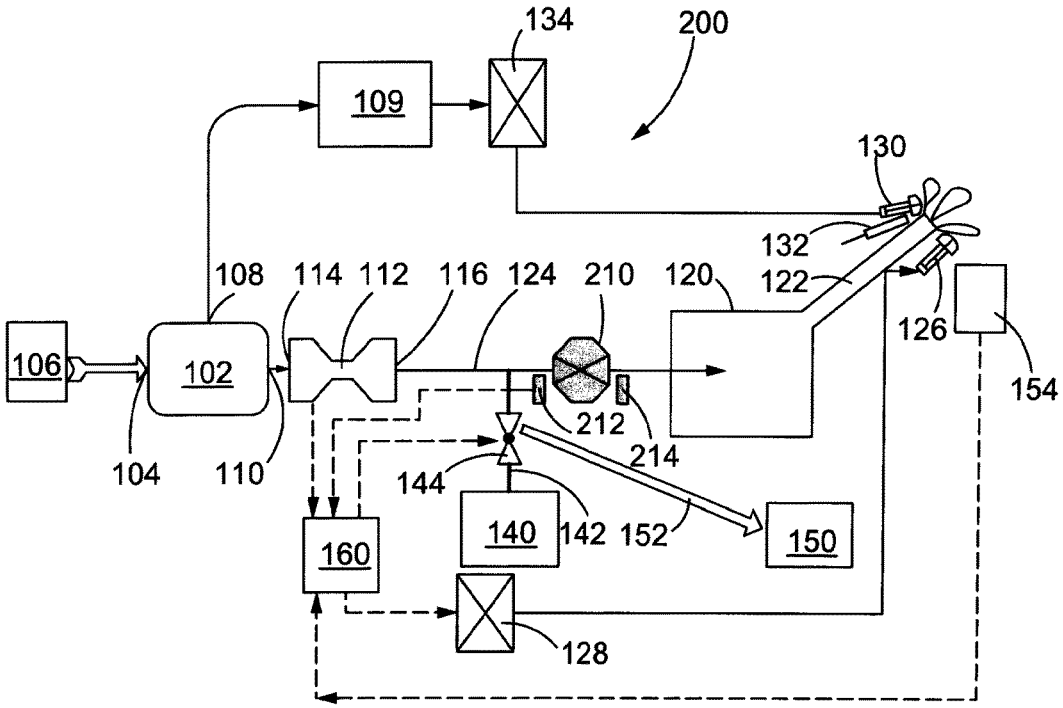
FIG. 2 is a diagrammatic view of an alternative embodiment of a multi-phase hydrocarbon fluid burning apparatus constructed according to the present disclosure.

FIG. 2 illustrates an alternative embodiment of a multi-phase hydrocarbon fluid combustion system 200 having an optional fuel preparation unit 210 disposed between the multi-phase flowmeter 112 and the burner 120. The fuel preparation unit 210 is configured to convert the multi-phase hydrocarbon liquid into a water-in-oil emulsion to provide a more uniform and environmentally-clean burning emulsified fuel. Combustion of emulsified fuel may reduce emissions (soot, NOx, etc.) and increase the level of water content that the multi-phase hydrocarbon liquid may have and still be cleanly combusted. The fuel preparation unit 210 may be a homogenizing device configured to produce a medium emulsion with an average droplet size of less than 10-20 microns.

The controller 160 may be operably coupled to the fuel preparation unit 210 and programmed to selective operate the fuel preparation unit 210 based on one or more determined characteristics of the multi-phase hydrocarbon liquid. For example, the controller 160 may be programmed to initiate operation of the fuel preparation unit 210 when the water content of the multi-phase hydrocarbon liquid is between a lower emulsion water content threshold (such as approximately 7%) and an upper emulsion water content threshold (such as approximately 40%). A viscosity sensor 212 may be provided at an inlet of the fuel preparation unit 210 and a pressure sensor 214 may be provided at an outlet of the fuel preparation unit 210 as shown in FIG. 2 to monitor the emulsification process.

Alternatively, the controller 160 may be programmed to control operation of the fuel preparation unit 210 based on the combustion quality of emission gases produced by the flame at the burner 120. For example, the fuel preparation unit 210 may be operated only when the emission monitor 154 indicates that an emission component, such as NOx or soot, exceeds an emission gases threshold.

Figure 3:
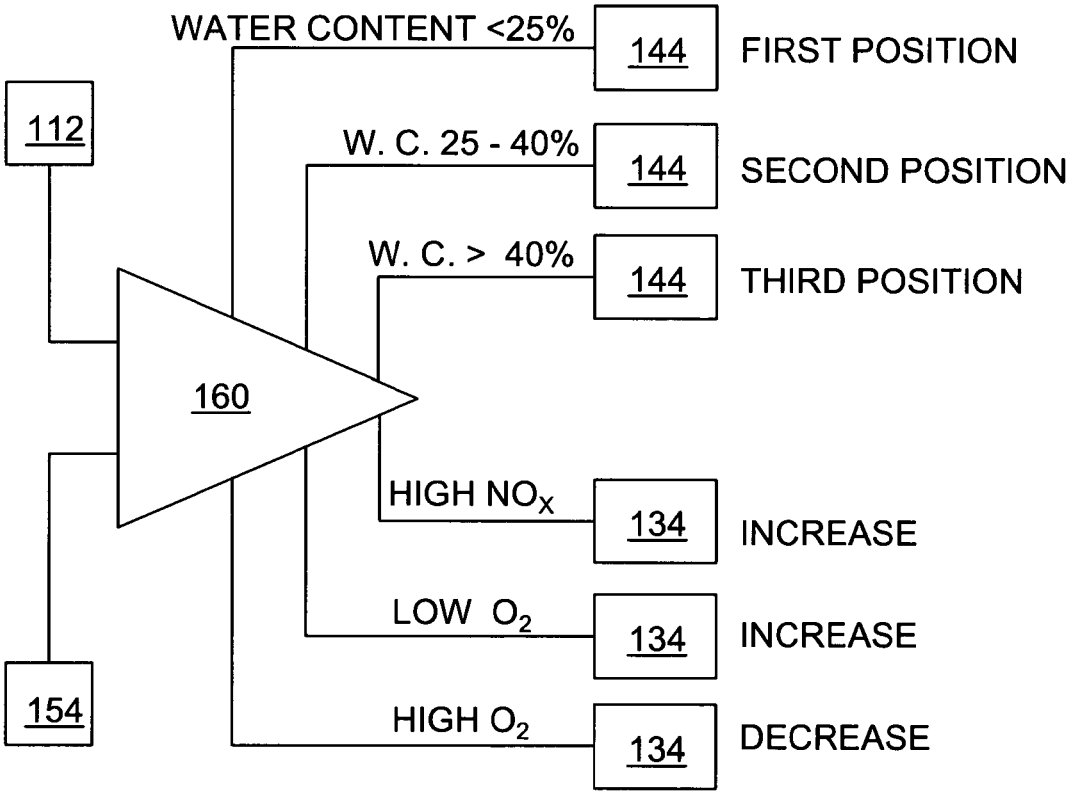
FIG. 3 is a schematic illustration of inputs and outputs of a controller used in the apparatus of FIG. 1 or 2.

FIG. 3 illustrates the various controller inputs and outputs. In the illustrated embodiment, the controller 160 receives water content and hydrocarbon content information from the multi-phase flowmeter 112, as well as NOx content and O2 content information from the emission monitor 154. Based on the information provided by the flowmeter 112 and emission monitor 154, the controller 160 may generate various outputs. For example, when the water content is below 25%, the controller 160 may operate the auxiliary fuel valve 144 to a first position that permits primary fuel flow from the flowmeter 112 to the burner 120 while blocking auxiliary fuel flow from the auxiliary fuel tank 140. Alternatively, if the water content is between 25% and 40%, the controller 160 may operate the auxiliary fuel valve 144 to a second position that permits primary fuel flow from the flowmeter 112 to the burner 120 and simultaneously permits auxiliary fuel flow from the auxiliary fuel tank 140 to the burner 120. Still further, if the water content is above 40%, the controller 160 may operate the auxiliary fuel valve 144 to a third position that blocks the primary and auxiliary fuel flows to the burner and directs the primary fuel to the diverter tank 150. The controller 160 may also control the air compressor xxx to increase air flow when the emission monitor 154 indicates a high NOx content of the emission gases. Similarly, the controller 160 may increase air compressor output when the emission monitor 154 indicates a low O2 content, or may decrease air compressor output when the emission monitor 154 indicates a high O2 content. The controller 160 is capable of these inputs and outputs, as well as the other inputs and outputs discussed herein, to more cleanly burn the multi-phase hydrocarbon fluid provided to the system.

In view of the foregoing, systems and methods are provided that may cleanly and efficiently combust multi-phase hydrocarbon fluid having a wide range of water contents. Auxiliary fuel may be selectively added to the fluid to improve subsequent combustion thereof. Additionally, fluid that cannot efficiently be combusted due to high water content is diverted from the burner to avoid release into the environment. Excess air supplied to the burner may be adjusted based on emission gases to further improve combustion. Each of these features reduces the amount of harmful emissions generated during combustion of multi-phase hydrocarbon fluids from well testing, oil spill cleanup, or other applications.

Although only a few example embodiments have been described in detail above, those skilled in the art will readily appreciate that many modifications are possible in the example embodiments without materially departing from the burner assembly and methods for flaring low calorific content gases disclosed and claimed herein. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structure.

What is claimed is:

1. A method of burning a multi-phase hydrocarbon fluid, comprising:

determining a water content of the multi-phase hydrocarbon fluid;

communicating the multi-phase hydrocarbon fluid to a fuel port of a burner in a primary fuel flow;

initiating a flame at the burner to combust the multi-phase hydrocarbon fluid;

communicating an auxiliary fuel source to the burner fuel port in an auxiliary fuel flow;

controlling the primary and auxiliary fuel flows based on the water content of the multi-phase hydrocarbon fluid.

2. The method of claim 1, in which controlling the primary and auxiliary fuel flows comprises:

permitting the primary fuel flow to the burner and blocking the auxiliary fuel flow to the burner when the water content is below a water content lower threshold;

permitting both the primary and auxiliary fuel flows to the burner when the water content is between the water content lower threshold and a water content upper threshold; and blocking the auxiliary fuel flow to the burner and diverting the primary fuel flow away from the burner when the water content is above the water content upper threshold.

3. The method of claim 2, in which the water content lower threshold is approximately 25% and the water content upper threshold is approximately 40%.

4. The method of claim 1, further comprising converting the multi-phase hydrocarbon fluid into a hydrocarbon emulsion prior to communication to the burner fuel port.

5. The method of claim 4, further comprising controlling the conversion of the multi-phase hydrocarbon fluid into the hydrocarbon emulsion based on a water content of the multi-phase hydrocarbon fluid, wherein conversion to the hydrocarbon emulsion is performed only when the water content of the multi-phase hydrocarbon fluid is between a lower emulsion water content threshold and an upper emulsion water content threshold.

6. The method of claim 5, in which the lower emulsion water content threshold is approximately 7% and the upper emulsion water content threshold is approximately 40%.

7. The method of claim 5, further comprising:

determining a combustion quality of emission gases produced by the flame; and controlling the conversion of the multi-phase hydrocarbon fluid into the hydrocarbon emulsion based on the combustion quality of emission gases, wherein conversion to the hydrocarbon emulsion is performed only when the combustion quality of emission gases exceeds an emission gases threshold.

8. The method of claim 1, further comprising, prior to determining the water content of the multi-phase hydrocarbon fluid, separating at least a portion of a gas component from the multi-phase hydrocarbon fluid.

9. The method of claim 8, further comprising communicating the portion of the gas content of the multi-phase hydrocarbon fluid to a pilot port of the burner.

10. The method of claim 1, further comprising:

determining a hydrocarbon content of the multi-phase hydrocarbon fluid; and communicating the multi-phase hydrocarbon fluid to the auxiliary fuel source when the hydrocarbon content exceeds a hydrocarbon content threshold.

11. The method of claim 1, further comprising communicating an air source to an air port of the burner in an air flow.

12. The method of claim 11, further comprising:

determining a combustion quality of emission gases produced by the flame; and controlling an air flow rate of the air flow based on the combustion quality of emission gases.

13. The method of claim 12, in which determining the combustion quality of emission gases includes determining a NOx content, and in which controlling the air flow rate comprises increasing the air flow rate when the NOx content is above an NOx threshold.

14. The method of claim 12, in which determining the combustion quality of emission gases includes determining an O2 content, and in which controlling the air flow rate comprises increasing the air flow rate when the O2 content is below an O2 lower threshold and decreasing the air flow rate when the O2 content is above an O2 upper threshold.

15. Apparatus for combusting a multi-phase hydrocarbon fluid, comprising:

a multi-phase flowmeter having a multi-phase flowmeter inlet fluidly communicating with a source of the multi-phase hydrocarbon fluid and a multi-phase flowmeter outlet, the multi-phase flowmeter being configured to determine a water content of the multi-phase hydrocarbon fluid;

a burner having a fuel port fluidly communicating with the multi-phase flowmeter outlet to receive an primary fuel flow of multi-phase hydrocarbon fluid, and an igniter configured to initiate a flame at the burner to combust the multi-phase hydrocarbon fluid;

an auxiliary fuel source fluidly communicating with the burner fuel port;

an auxiliary fuel valve disposed between the auxiliary fuel source and the burner fuel port, the auxiliary fuel valve having a first position configured to block an auxiliary fuel flow to the burner fuel port and a second position configured to permit the auxiliary fuel flow to the burner fuel port;

a controller operatively coupled to the multi-phase flowmeter and the auxiliary fuel valve, the controller being programmed to control the primary and auxiliary fuel flows based on the water content of the multi-phase hydrocarbon fluid.

16. The apparatus of claim 15, in which the controller is further programmed to:

operate the auxiliary fuel valve to the first position when the water content is below the water content lower threshold;

operate the auxiliary fuel valve to the second position when the water content is between a water content lower threshold and a water content upper threshold; and operate the auxiliary fuel valve to a third position when the water content is above the water content upper threshold, wherein the third position of the auxiliary fuel valve is configured to both block auxiliary fuel flow to the burner and divert primary fuel flow away from the burner.

17. The apparatus of claim 16, in which the water content lower threshold is approximately 25% and the water content upper threshold is approximately 40%.

18. The apparatus of claim 15, further comprising a fuel preparation unit disposed between the multi-phase flowmeter and the burner, the fuel preparation unit being configured to convert the multi-phase hydrocarbon fluid into a hydrocarbon emulsion.

19. The apparatus of claim 18, in which the controller is operably coupled to the fuel preparation unit and further programmed to initiate operation of the fuel preparation unit when the water content of the multi-phase hydrocarbon fluid is between a lower emulsion water content threshold of approximately 7% and an upper emulsion water content threshold of approximately 40%.

20. The apparatus of claim 15, further comprising a separator having a separator inlet fluidly communicating with the source of the multi-phase hydrocarbon fluid, a separator liquid outlet fluidly communicating with the multi-phase flowmeter inlet, and a separator gas outlet, the separator being configured to separate at least a portion of a gas content from the multi-phase hydrocarbon fluid.

21. The apparatus of claim 20, further comprising a gas reservoir fluidly communicating with the separator gas outlet and configured to receive the portion of the gas content of the multi-phase hydrocarbon fluid, the gas reservoir further fluidly communicating with a pilot port of the burner.

22. The apparatus of claim 15, in which the burner further comprises an air port fluidly communicating with an air source to receive an air flow having an air flow rate.

23. The apparatus of claim 22, further comprising an emission monitor configured to determine a combustion quality of emission gases produced by the flame, and in which the controller is further programmed to control the air flow rate based on the combustion quality.

24. The apparatus of claim 23, in which the emission monitor is configured to determine an NOx content and an O2 content of emission gases, and in which the controller is further programmed to:

increase the air flow rate when the NOx content is above an NOx threshold;

increase the air flow rate when the O2 content is below an O2 lower threshold; and decrease the air flow rate when the O2 content is above an O2 upper threshold.

* * * * *